US007552892B1

(12) United States Patent
Bittle et al.

(10) Patent No.: US 7,552,892 B1
(45) Date of Patent: Jun. 30, 2009

(54) DUAL-SLIDING FIN LOCK ASSEMBLY

(75) Inventors: David A. Bittle, Somerville, AL (US); Gary T. Jimmerson, Athens, AL (US); Julian L. Cothran, Arab, AL (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 453 days.

(21) Appl. No.: 11/613,228

(22) Filed: Dec. 20, 2006

(51) Int. Cl.
*F42B 10/14* (2006.01)

(52) U.S. Cl. ..... 244/3.29

(58) Field of Classification Search ..... 244/3.27, 244/3.28, 3.29, 49
See application file for complete search history.

(56) References Cited

U.S. PATENT DOCUMENTS 2,858,765 A * 11/1958 Startzell ..... 244/3.29
4,673,146 A * 6/1987 Inglis ..... 244/3.23
6,186,442 B1 * 2/2001 Bittle ..... 244/3.29
6,739,548 B1 * 5/2004 Bittle et al. ..... 244/3.29

* cited by examiner

*Primary Examiner*—Rob Swiatek
(74) *Attorney, Agent, or Firm*—Hay Kyung Chang

(57) ABSTRACT

The Dual-Sliding Fin Lock Assembly provides a simple, cost-effective and secure locking mechanism that engages on the initial opening stroke of a fin of a flying object, using a minimal number of parts that are easy to manufacture. Two sliding locks, each having a protruding step, engage with two fin lugs each of which has a corresponding notch. When a step and a notch fit together, they form a contact plane which may be straight horizontal or inclined to ensure robust locking operation without the need for extremely tight tolerances on the individual parts or on the assembly. Since the sliding locks do not rotate around the pin that holds the fin lugs, they engage the fin lugs to arrest the rotation of the fin and retain it securely in the deployed position for the duration of the object's flight, guiding the object more accurately toward its destination.

13 Claims, 4 Drawing Sheets

DUAL-SLIDING FIN LOCK ASSEMBLY

The invention described herein may be manufactured, used and licensed by or for the Government for U.S. governmental purposes; provisions of 15 U.S.C. section 3710c apply.

BACKGROUND OF THE INVENTION

In order to direct a flying object, such as a missile, to its intended destination more steadily and accurately, the flying object's control surfaces (also commonly referred to as wings or tailfins) must be deployed from their stowed or launch positions and then locked into their fully opened or deployed positions. The current state of the art for such locking typically employs five basic types of mechanisms. However, all of the five types suffer from serious drawbacks.

The first type of mechanism uses a plunge pin contained in the fin base portion that extends into the rotating fin body as the fin rotates to reach its deployed position. This has proven to be robust in operation but expensive to manufacture and assemble, since it requires a relatively thick fin base portion to contain the plunge pin mechanism, multiple machining operations using precision jigs to produce the mating plunge pin holes in the fin and careful assembly where each fin assembly is shimmed individually to tight tolerances to ensure that sections of the plunge pin hole are properly aligned.

The second type of mechanism utilizes tapered protrusions on fin lugs that engage matching slots in the stationary lugs that reside on the body of the flying object. This locking mechanism yields solid and robust fin locking but the tapered protrusions are difficult and expensive to produce. Further, the required axial translation of the fin demands a large compression spring to ensure reliable operation. Additionally, the entire locking process is slow.

The third type uses a flexible plate attached to the rotating fin that snaps over a lug on the object body. The mechanism requires precision adjustment, dictating that each fin be adjusted individually and tested during assembly of the flying object. If the plate is too tight, it impedes deployment of the fin and if it is too loose, it fails to lock tightly.

The fourth type uses a separate locking piece with a tapered slot that engages a matching protrusion machined on the face of the rotating fin lug. The locking piece cannot rotate against the object body, so the fin motion is arrested when the lock engages the fin lug. The required tapered protrusion on the inside face of the fin lug is difficult and expensive to fashion.

The fifth type of locking mechanism forces the fin axially aft onto a machined cut in the aft stationary fin lug. This requires translation of the entire fin in order to operate. The resulting engagement of the lock is slow and multiple fin rebounds are sometimes encountered during flight of the object before the lock engages successfully.

SUMMARY OF THE INVENTION

The Dual-Sliding Fin Lock Assembly overcomes the drawbacks of above-described locking mechanisms by using a pair of non-rotating sliding locks that engage the lugs on the fin upon the full deployment of the fin. The locking interface (contact plane) is a machined cut straight (horizontal) across the face of the lug, which is simple and inexpensive to produce. With this lock assembly, no axial translation of the fin is required, so the locking occurs quickly to arrest the motion of the fin without rebounds of the fin or other locking failures. To enhance the security of the lock, the locking interface may be made to incline, thereby producing a wedging effect.

DESCRIPTION OF THE PREFERRED EMBODIMENT

Figure 1:
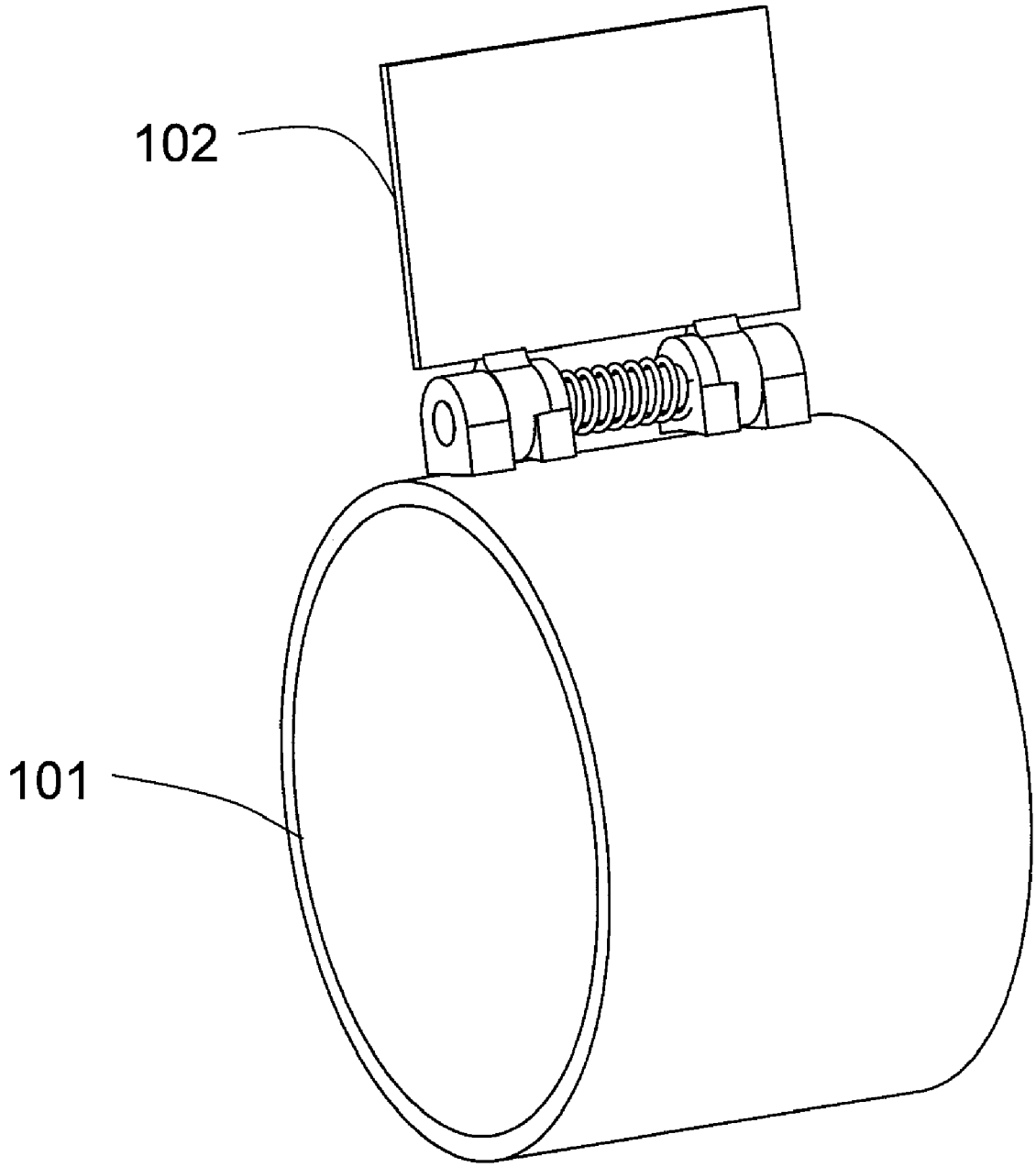
FIG. 1 depicts the dual-sliding fin lock assembly that may be used with a flying object, such as a missile, a portion of which is illustrated.

Referring now to the drawing wherein like numbers represent like parts in each of the several figures, details of the dual-sliding fin lock assembly are presented.

Any and all of the numerical dimensions and values that follow should be taken as nominal values rather than absolutes or as a limitation on the scope of the invention. These nominal values are examples only; many variations in size, shape and types of materials may be used, as will readily be appreciated by one skilled in the art, as successfully as the values, dimensions and types of materials specifically set forth hereinafter. In this regard where ranges are provided, these should be understood only as guides to the practice of this invention.

FIG. 1 shows flying object 101, with fin 102 (also referred to as wing) fully opened and locked into its completely deployed position. The flying object is thereby enabled to fly more steadily and accurately to its destination. There may be many such fins and locking assemblies employed on one flying object, evenly distributed around the circumference of the object. The optimum place for the fins or wings to be positioned depends on the overall configuration and characteristics of the object.

Figure 2:
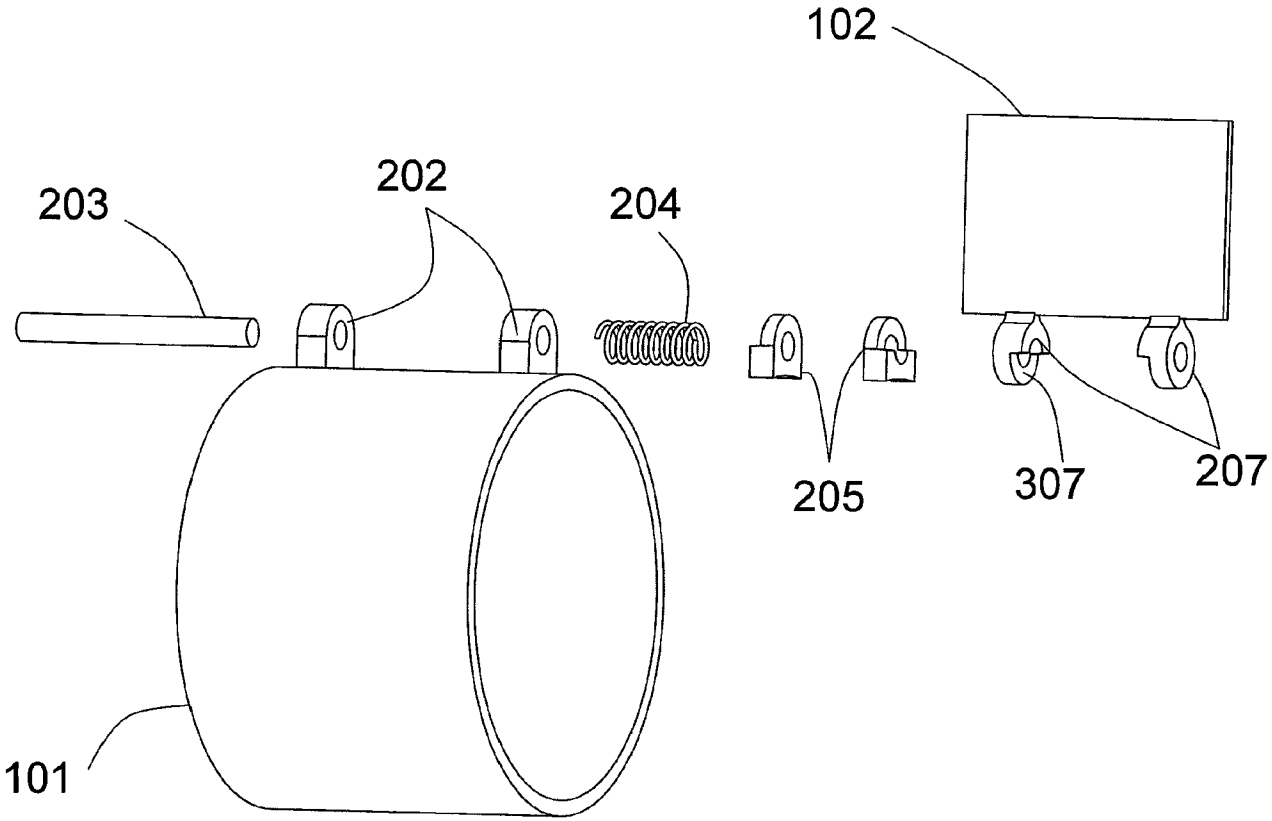
FIG. 2 is an exploded view of the fin lock assembly.
Figure 3:
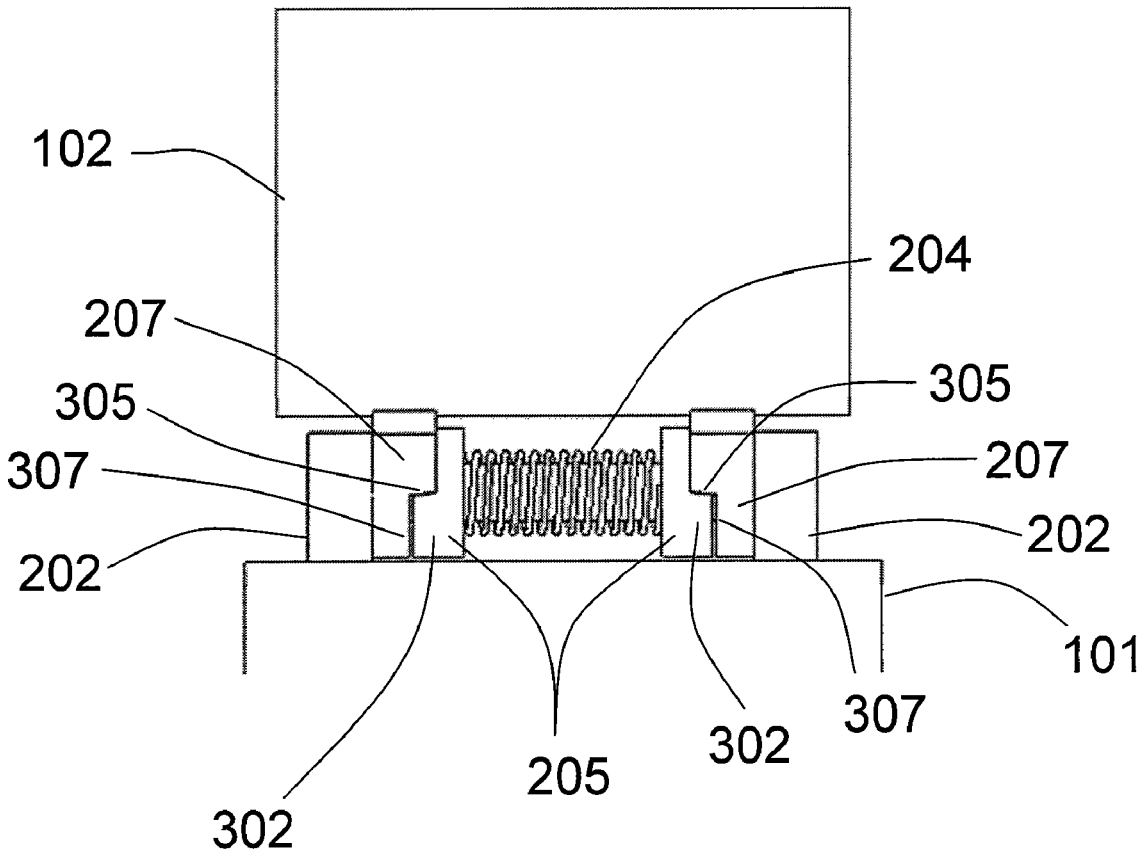
FIG. 3 shows a side view of the fin lock assembly.

FIG. 2 illustrates the locking assembly in an exploded view while FIG. 3 shows how the components of the assembly fit together.

From the outer surface of flying object 101, multiple object lugs 202 protrude. The wing or fin 102 is coupled to the object 101 by hinge pin 203 that engages co-axial holes in object lugs 202 and in fin lugs 207. Sliding locks 205, which cannot rotate against the surface of object 101 are positioned between the object lugs and one fin lug is sandwiched between one object lug and one sliding lock. Each of the lugs and the sliding locks has a hole through the center thereof through which the pin is passed to effect the threading. Compression spring 204 is placed around the hinge pin and between the sliding locks 205, as shown in FIG. 3. The compression force of the spring acts upon the two sliding locks to force them against corresponding lug faces of the fin lugs, forming a horizontal or inclined contact plane 305.

Upon launch of the flying object, fin 102 deploys (by torsion spring, air dynamic force or any other suitable means) from its stowed position. As it deploys, protruding step 302 of each sliding lock 205 comes into alignment with notch 307 in each fin lug 207. Compression spring 204 acts on the sliding locks to force them against the fin lugs so that the steps and the notches engage. The sliding locks fully engage the fin lugs, thusly, during the opening stroke of the fin. When the sliding locks have fully engaged, the opening rotational motion of the fin, together with the sliding locks, causes the bottom edge of the sliding locks to bear against the outer surface of the object. As the sliding locks bear against the object's outer surface, the motion of the fin is arrested. The fin is retained in its deployed and locked position by the sliding locks for the duration of the object's flight.

Figure 4:
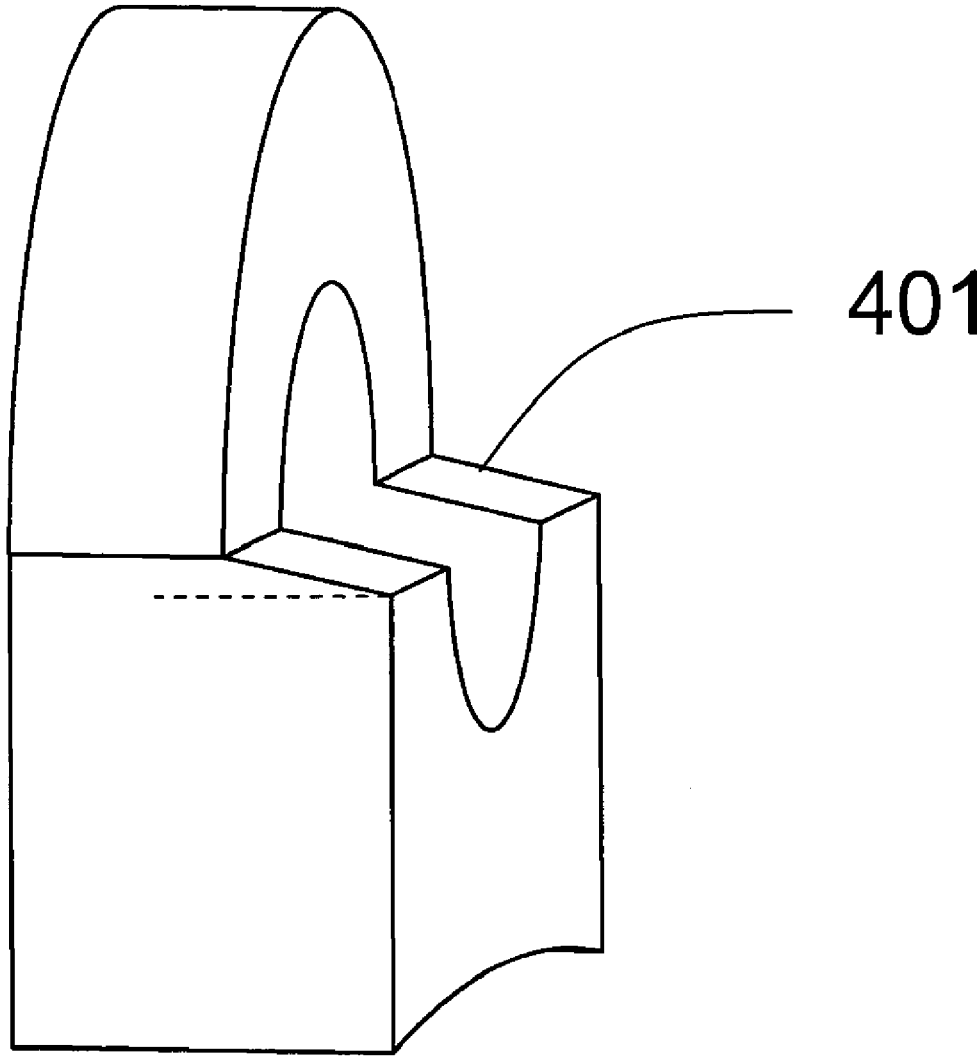
FIG. 4 illustrates the incline of the contact plane between a sliding lock and a fin lug.

The contact plane 305 formed when the step and notch come together can be straight horizontally, which makes the machining of the step and notch easy. For more secure locking, contact plane 401 can be made to incline slightly (relative to the horizontal, as illustrated by the straight dashed lines in FIG. 4), thereby forming a wedge, so that the fin will lock more securely against the object body without the need for extremely tight tolerance controls.

The fin lug holes are slightly larger than the diameter of the pin so as to allow the fin to rotate freely about the pin to reach its deployed position and the sliding lock holes are large enough to allow the locks to slide freely along the length of the pin.

Some suitable materials for the object lugs and sliding locks are aluminum alloy for low cost, lightweight, corrosion resistance, dimensional stability and ease of manufacture; or a suitable steel alloy. The fin and its lugs can be either molded from resin and fiber composites or machined from aluminum alloys, beryllium alloys or other similar lightweight materials. The compression spring should be made from high-quality metallic spring alloys and the hinge pin from corrosion-resisting steel for strength, stiffness and corrosion-resistance purposes.

The Dual-Sliding Fin Lock Assembly as described above securely locks the deployed fin (or wing) into place on the body of a flying object, allowing the object to operate within its normal flight parameters. The reliable operation of the fin lock assembly completely eliminates both over-rotation of the fin and inconsistent engagement of the fin locking mechanism.

Although a particular embodiment and form of this invention has been illustrated, it is apparent that various modifications and embodiments of the invention may be made by those skilled in the art without departing from the scope and spirit of the foregoing disclosure. Accordingly, the scope of the invention should be limited only by the claims appended hereto.

We claim:

1. A multi-sliding fin lock assembly for locking a deployed fin in place on a flying object so as to render stability to the flight of the object and enable the object to reach its preselected destination more accurately, said lock assembly comprising: a plurality of object lugs, said object lugs each having a hole therethrough and being fixedly attached to the outer surface of said object while being separated by a given distance from each other; a fin; a plurality of sliding locks, said locks each having a hole therethrough and a protruding step, said sliding locks being positioned between said object lugs; a plurality of fin lugs attached to said fin, said fin lugs each having a hole therethrough and a notch, said step and notch allowing said sliding lock and said fin lug to fit together, each fin lug being sandwiched between one object lug and one sliding lock; a pin passing through said holes of said object lugs, fin lugs and sliding locks, said pin thereby securing said fin to said object; and a means to maintain said fin firmly in the deployed position for the duration of the flight of the object.

2. A multi-sliding fin lock assembly as set forth in claim 1, wherein said maintaining means comprises a spring compressed between said sliding locks, said spring surrounding said pin.

3. A multi-sliding fin lock assembly as set forth in claim 2, wherein said sliding locks are non-rotatably positioned on said object so as to allow said step on a said sliding lock and said notch on a said fin lug to fit together to form a tight contact plane upon said fin's full deployment.

4. A multi-sliding fin lock assembly as set forth in claim 3, wherein the diameter of said holes through said fin lugs are sufficiently larger than the diameter of said pin so as to allow said fin lugs to rotate freely about said pin.

5. A multi-sliding fin lock assembly as set forth in claim 4, wherein said contact plane is horizontal.

6. A multi-sliding fin lock assembly as set forth in claim 4, wherein said contact plane is slightly inclined to enhance the lock between said sliding lock and fin lug.

7. A dual-sliding fin lock assembly for locking a deployed fin in place on a flying object so as to impart stability to the flight of the object and enable the object to reach its preselected destination more accurately, said assembly comprising: a first and a second object lug, said object lugs each having a hole therethrough and being fixedly attached to the outer surface of said object, said first and second object lugs being separated by a given distance from each other; a fin; a first and a second sliding lock, said locks each having a hole therethrough and a protruding step, said sliding locks being fixedly positioned between said object lugs; a first and a second fin lug attached to said fin, said fin lugs each having a hole therethrough and a notch, said step and notch allowing said sliding lock and said fin lug to fit together, said first fin lug being sandwiched between said first object lug and said first sliding lock while said second fin lug is sandwiched between said second object lug and said second sliding lock; a pin passing through said holes of said object lugs, fin lugs and sliding locks, said pin thereby securing said fin onto said object; and a means to maintain said fin firmly in the deployed position for the duration of the flight of the object.

8. A dual-sliding fin lock assembly as set forth in claim 7, wherein said maintaining means comprises a spring compressed between said sliding locks, said spring surrounding said pin.

9. A dual-sliding fin lock assembly as set forth in claim 8, wherein said holes through said fin lugs are sufficiently larger than the diameter of said pin so as to allow said fin lugs to rotate freely about said pin until said fin reaches full deployment.

10. A dual-sliding fin lock assembly as set forth in claim 9, wherein said sliding locks are positioned on said object to allow said step on said first sliding lock and said notch on said first fin lug to fit together to form a first tight contact plane upon said fin's full deployment.

11. A dual-sliding fin lock assembly as set forth in claim 10, wherein said sliding locks are positioned on said object to allow said step on said second sliding lock and said notch on said second fin lug to fit together to form a second tight contact plane upon said fin's full deployment.

12. A multi-sliding fin lock assembly as set forth in claim 11, wherein said contact planes are horizontal.

13. A multi-sliding fin lock assembly as set forth in claim 11, wherein said contact planes are slightly inclined to enhance the lock between said sliding locks and fin lugs.

* * * * *